United States Patent [19]

O'Connor

[11] Patent Number: 4,568,033

[45] Date of Patent: Feb. 4, 1986

[54] WINDING A PACKAGE OF TAPE

[76] Inventor: Lawrence O'Connor, P.O. Box 489, Lot 6, Clearwater Bay, Ontario, Canada, P0X 1C0

[21] Appl. No.: 631,250

[22] Filed: Jul. 16, 1984

[30] Foreign Application Priority Data

Jul. 20, 1983 [GB] United Kingdom ..... 8319629

[51] Int. Cl.[4] ..... B65H 54/28; B65H 55/04

[52] U.S. Cl. ..... 242/67.1 R; 242/174; 242/176

[58] Field of Search ..... 242/1, 55, 67.1, 60, 242/158 R, 158 B, 158.2, 158.4, 159, 167, 174, 176, DIG. 2, 178

[56] References Cited

U.S. PATENT DOCUMENTS

| | | | |
|---|---|---|---|
| 2,912,187 | 11/1959 | Rau, Jr. | 242/158.4 |
| 3,319,070 | 5/1967 | Schneider | 242/158 R |
| 4,244,539 | 1/1981 | Taneda et al. | 242/158 R |

OTHER PUBLICATIONS

Western Electric Technical Digest No. 27, Ingham, Jul. 1972.

*Primary Examiner*—Stuart S. Levy
*Assistant Examiner*—Lloyd D. Doigan
*Attorney, Agent, or Firm*—Adrian D. Battison

[57] ABSTRACT

A package of tape is formed with flanged portions built up at the ends and a central helical traverse portion. The flanged portions are effectively formed by a plurality of separate spiral windings each of which is interlocked with each other and the central traverse portion. The central portion is formed from a plurality of helical traverses with reversal positions slightly inside the inner edge of the flanged portions. Either the central traverse portion or the flanged portions is built up first to form a step following which the other is built up to meet the step. The step cannot be so high that the tape cannot traverse the step. The extreme ends of the package is thus formed by the stable spiral windings while edge drop-off from the ends of the traverse portion is limited to height of the last helical traverse.

12 Claims, 5 Drawing Figures

WINDING A PACKAGE OF TAPE

This invention relates to a method and apparatus for winding a package of tape and also to a package of tape when wound by the method.

Tape is used in many industries of varying widths and thicknesses dependent upon the end use. Some wider tapes are spirally wound on a core without any traverse movement so that each layer is formed on top of the previous layer thus forming what is known as a pad. However this arrangement obviously is very limited in the amount of tape that can be included on the package and is totally unsatisfactory for narrower tapes of the order of ¼ inch or less.

In order to accommodate more tape on a package, tapes have also been wound as traverse packages where the tape is traversed back and forth across the core to form an elongated package substantially longer than the width of the tape. Normally the angle of wind of such traverse packages provides a movement for each circumference of the package which is less than the width of the tape so that the tapes overlap as they are wrapped around the package. However greater angles can be employed in some circumstances. The major problem with packages of this type is that the ends of the packages or shoulders of the package are very susceptible to damage and are very unstable with only a part of each tape at the shoulder being bound into the package. Thus the tapes are inclined to slip out of the package, in a weakness known as edge drop off, and become tangled at the ends of the package which make the package unsightly and also can seriously interfere with the pay off of the tape. This edge drop off is made worse by the fact that many tapes are very slippery and hence have little interlocking forces except when contacted over a major portion of their surface.

This tendency of the ends of the package to collapse increases in narrower tapes (less than ½ inch) since proportionally less of their width is bound into the remainder of the package. In some very narrow tapes (less than ¼ inch) this problem is so severe that the tapes cannot be bound onto conventional traverse packages without the use of flanges on the core to support the package. Even in this case tape can slide down between the ends of the package and the flanges thus interfering with the pay off and causing a break of the tape. Furthermore packages which are wound on flanged cores are seriously disadvantageous in that the flanged core is an expensive item which requires to be recycled and hence returned to the manufacturer of the packages from an end user.

Narrower tapes of this type are used in many industries for example tear-tapes are used in large quantities for cigarette packaging.

In U.S. Pat. No. 4,093,146 (Haley) modification is made to the traverse at the ends of the package to attempt to improve the formation of the ends. Thus there is provided a dwell at the end of the package in order to reduce the angle between the approaching tape and the receding tape as the direction changes at the end of the package. This is used because the inventor is concerned with particularly thick tape which tends to set while packaged thus retaining the kink formed by this change of direction. In addition the inventor provides a technique for calculating the amount of dwell in conjunction with that portion of a rotation of the traverse beyond a whole number of rotations in order to ensure that the reversal points at the end of the package fall in a particular pattern.

The amount of dwell as taught by Haley is however very small and certainly less than 360°. Furthermore Haley teaches that as the dwell angle increases (up to 270° is mentioned) the quality of the package deteriorates.

In any event, Haley does not provide any solution to the problem of improving the control or holding forces on the tape and particularly narrower tapes and hence edge drop off remains a problem.

It is one object of the present invention to provide a novel method and apparatus for winding a package of tape which form a novel package construction which is more resistant to edge drop off.

In accordance with a first aspect of the invention, therefore, there is provided a method of building a package of tape wound on a core comprising forwarding the tape from a supply thereof, guiding the tape to a winding position on the core, rotating the core to wrap the tape around the core and traversing the winding position across the core to form a package, the improvement wherein at each end of the package the winding position is during the package build repeatedly maintained stationary for a period of time sufficient to wind during each period a separate spiral winding of at least one full turn whereby to form at each end of the package a flanged portion of the package which is substantially comprised of said spiral windings and in between said flanged portions the winding position is, during the package build, repeatedly traversed axially of the package to wind the tape helically of the core to form a helical traverse portion of the package.

According to a second aspect of the invention there is provided a package of tape including at each end a respective one of a pair of flanged portions and a helical traverse portion intermediate the flanged portions, the flanged portions each being comprised of a series of separate overlying spiral windings of at least one full turn and the helical traverse portion being comprised of a series of separate helical traverses, each separate spiral winding of a flanged portion being separated from the next overlying by one of said separate helical traverses and arranged such that the diameter of the flanged portion at said separate spiral winding is substantially equal to the diameter of said helical traverse portion at said separate helical traverse.

According to a third aspect of the invention there is provided an apparatus for building a package of tape on a core comprising means for forwarding the tape from a supply thereof, guide means for guiding the tape to a winding position on the core, means for supporting the core for rotation relative to the winding position to wrap the tape around the core, traverse means for traversing the winding position relative to the core to form a package and traverse control means arranged such that at each end of the package the winding position is during the package build repeatedly maintained stationary for a period of time sufficient to wind during each period a separate spiral winding of at least one full turn whereby to form at each end of the package a flanged portion of the package which is substantially comprised of said spiral windings and in between said flanged portions the winding position is during the package build repeatedly traversed axially of the package to wind the tape helically of the core to form a helical traverse portion of the package.

The package is therefore formed in a continuous winding process to produce during the process flanged portions at the ends of the package and a central traverse portion between the flanges.

The flanged portions in view of the fact that they are basically formed from spiral windings are very much more resistant to collapse or edge drop-off. The main body of the package is formed by the helical traverse portion at the centre of the package and this portion acts to effectively support the package for contacting a drive roller or lay-on roller by which the tape can be led to the package.

The flanges or flanged portions are therefore built up in a series of steps during the formation of the package and the package is therefore effectively self-flanged as opposed to the prior packages which require a separate structure of the core to provide the required flange. In addition the flanged portions are continually interlocked with each other and with the helical traverse portion throughout the build by the traverse movement into and out of the spiral windings at each commencement and completion of a spiral winding.

These interlocking traverses also act to limit the amount of edge drop-off which can occur from the traverse portion of the package. Thus if edge drop-off does occur at the end of the traverse portion, the amount of drop-off which can occur is that which falls to the next interconnecting section of the tape as opposed to conventional packages where edge drop-off can fall right to the base of the core on which the package is formed.

The package according to the invention therefore has the advantages that it is basically formed by the traverse winding section or portion at the centre of the package and, as is well known, such traverse wound packages have a strong and stable structure apart from at the edges of the package where such edge drop-off can occur. Furthermore the package is effectively self-flanged so that the extreme ends of the package are formed by stable interlocked spiral windings which are further stabilized by their interconnection with the traverse portion.

In a particularly preferred arrangement in each cycle of winding the traverse portion is formed firstly to build a substantial and resistance base for the package against which the lay-on roller can contact. When a sufficient height of the traverse portion has been completed including a number of direction reversal points at each end of the traverse portion, an interconnecting layer of tape is traversed to the end flange portion whereupon a flange is built up by a first spiral winding including a number of turns greater than one up to a level substantially equal to the height of the traverse portion. Subsequently the flanged portion at the other end of the package is completed again substantially up to the height or diameter of the traverse portion. This completes a first cycle of the package following which further cycles are completed with each cycle acting to build a traverse portion and interlocking the traverse portion with the flanged portions.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which.

Figure 1:
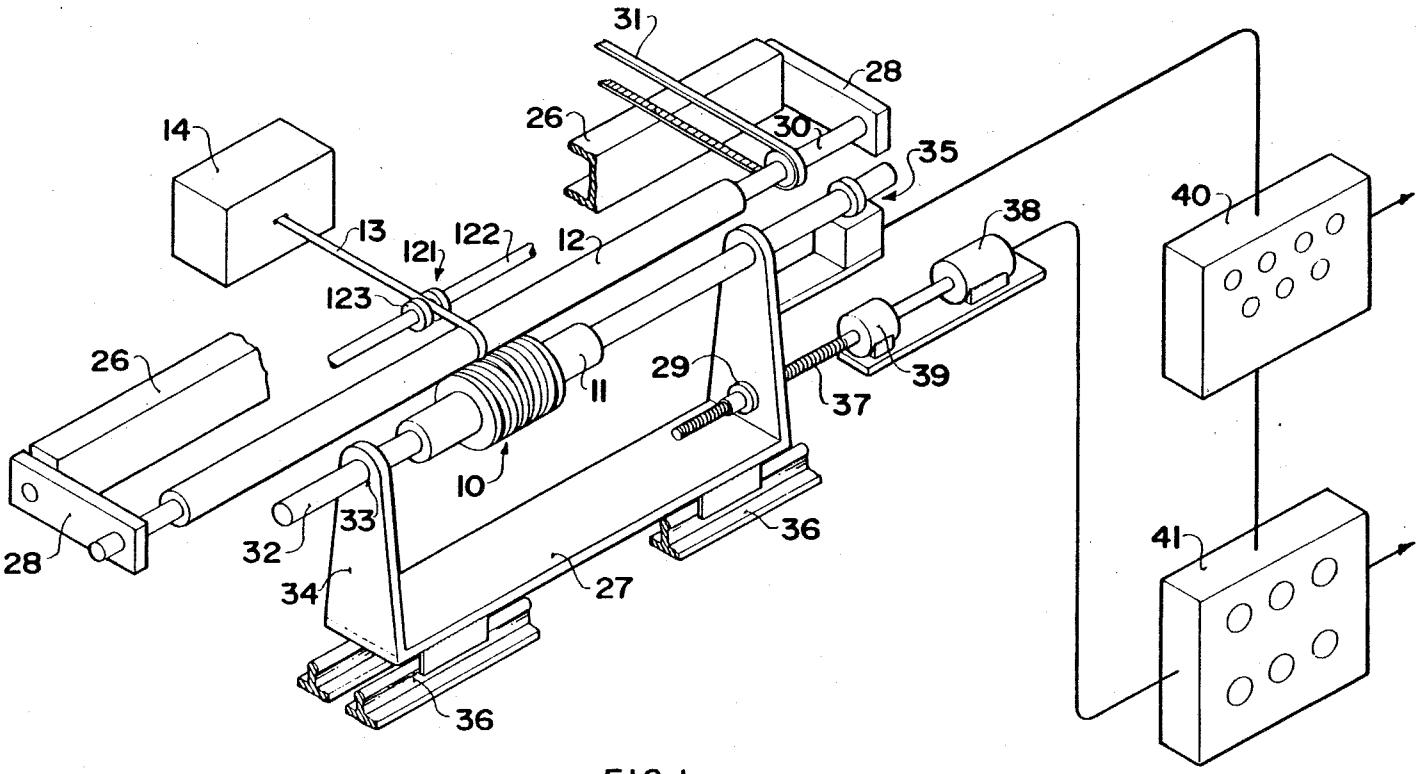
FIG. 1 is a schematic isometric view of a package and package driving roller showing the tape in the process of winding onto a partially completed package including a control device for the traverse mechanism.

In FIG. 1 the package of tape is schematically indicated at 10 and is mounted upon a mandrel 11 for free rotation about its axis. The package is in contact with a driven lay-on roller 12 which also acts to guide tape 13 from a supply position schematically indicated at 14. The supply 14 can comprise a slitting station in which case there will be formed on the machine a plurality of packages 10 or it can comprise any other supply from which the tape needs to be wound.

The tape 13 is forwarded by the lay-on roller 12 and is held in constant position on the lay-on roller by guide discs 121 while the package 10 is traversed along its length relative to the lay-on roller 12 so as to move the winding position along the package.

The details of the mounting arrangement for the package and also the drive and control for the traverse arrangement will be described hereinafter.

Figure 2:
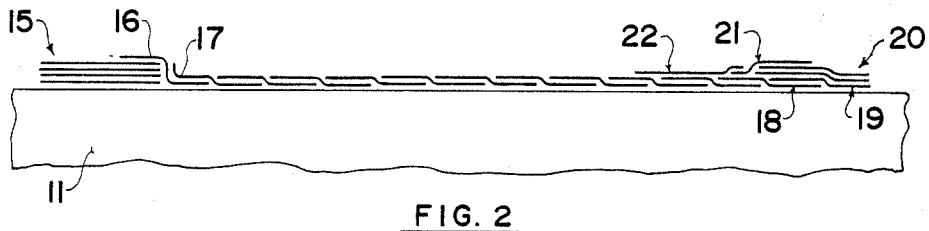
FIG. 2 is a schematic cross sectional view showing a first layer of tape on the package of FIG. 1.
Figure 3:
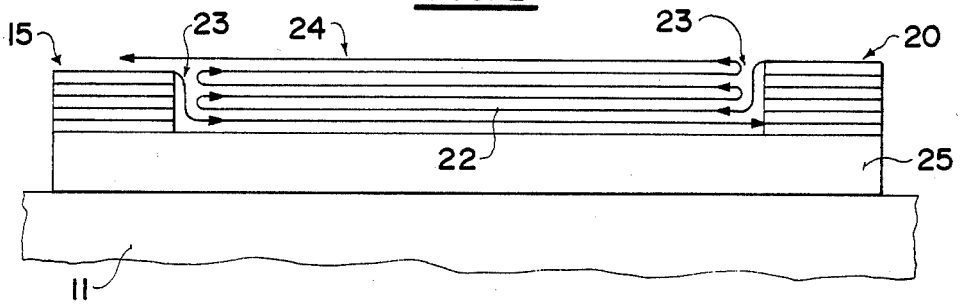
FIG. 3 is a schematic illustration of a cycle of winding taken at a position within the building of the package of FIG. 1.

Turning now to FIGS. 2 and 3, and initially to FIG. 2 there is shown schematically as separate lines a first part of a cycle of winding tape on the package core. The core is schematically illustrated at 11 and it will be appreciated that this can comprise either the mandrel or a separate core which is free from flanges for supporting the ends of the package. Initially the tape is secured to the mandrel or core and then a plurality of spiral turns 15 are formed at one end of the intended package thus forming a step or flanged portion of tape on the core 11. When the step is complete, the winding position is then traversed towards the right so the next layer of tape indicated at 16 moves across from the step and partially drops to the level of the core to form a first layer on the core of a traverse wound package. The rate of traverse is controlled so that the next layer of tape indicated at 17 overlaps the first layer 16 by an amount which can be varied in accordance with requirements. Thus a complete layer of tape is traversed across the full width of the package until the other end position is reached. At the other end position the winding position is maintained stationary so that a plurality of spirals 19, 20 are formed at the end position. It will be noted that the first layer 19 of the spiral is wrapped over a traverse wind layer indicated at 18 since the layer 18 forms the change over or interconnection between the traverse and the spiral winding. When a further step or flanged portion is formed of the spirals 19, 20 of equal height to the first step formed by the spirals 15, the next layer 21 is again traversed from the end position into the traverse position followed by a plurality of helical traverses 22.

In view of the complication of continuing this mode of illustration of the winding technique, FIG. 3 illustrates the steps or flanged portions 15, 20 as merely rectangular blocks with the helical traverses illustrated merely as straight lines intermediate the steps 15, 20. Thus it will be noted that the steps are higher than a single layer of the traverse and that when the step 20 has been completed a plurality of traverses of the area intermediate the steps 15 and 20 is completed thus forming a helical traverse portion 24 which attains the height of the steps 15, 20.

There are therefore a number of reversal positions schematically indicated at 23 of the helical traverse portion 24 with the reversal positions inward of the steps 15 and spaced slightly therefrom so as to avoid the formation of a ridge of tape at the reversals formed by those sections of tape which enter and leave the steps 15, 20.

The spacing of the reversals 23 from the inner edge of the shoulder portion is arranged to be less than the width of the tape so as to reduce the possibility of the tape slipping between the two tape positions.

Following the completion of the traverse portion 24 including the reversals 23, a further portion of the steps 15, 20 is formed with a single traverse between steps 15, 20 merely to transfer the tape from one end to the other end to form the steps 15, 20.

The minimum number of spirals at each end position which is certainly greater than one full turn and preferably greater than two turns is that which allows the end positions to be formed in such a manner that the tape is well bound into the end spirals. Of course an increased number of inward and outward portions of tape would detract from the proper construction of the ends spirals.

The maximum number of turns at the end positions is governed by the differential in height which the tape has to traverse between the flanged portions and the intermediate helical traverse portion which is dependent upon the width of the tape and also any changes in winding tension which can occur due to changes in diameter of the package.

It will also be apparent to those skilled in the art that the winding force may be applied to the mandrel 11, such procedure being known as center wind. In this case the lay-on roller 12 is freely rotatable and is driven by the incoming tape.

It will be noted that the traverse portion is considerably wider than a single width of tape so the main body of the package is formed by the traverse portion. It will also be noted that the width between the reversal positions and the end positions is less than the width of a tape to inhibit tape from entering into the gap and causing problems in unwinding.

Figure 4:
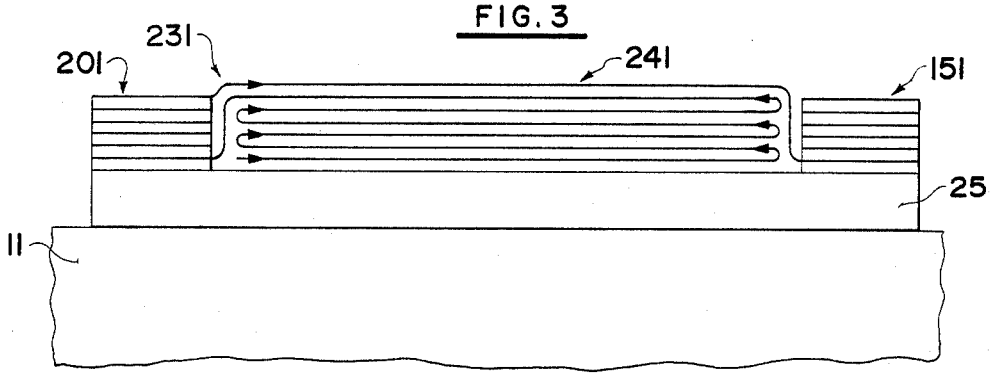
FIG. 4 is a view similar to FIG. 3 showing a modified package build in which the traverse portion is formed before the shoulder portion.

FIG. 4 shows a modified arrangement similar to FIG. 3 in which a base portion of the package is indicated at 25. One cycle of the formation of the package is then illustrated schematically wherein firstly the helical traverse portion is formed indicated at 241 with reversals 231. When complete, the tape or winding position is traversed into one of the flanged portions 151 to build up the flanged portion by spiral turns thus forming a spiral winding up to or near to the level formed by the helical traverse portion 241. Subsequently the tape or winding position is traversed to the other end or flanged portion illustrated at 201 whereupon the other end portion is formed again up to the same level to provide a substantially constant diameter of the package at the end of the cycle. Subsequently further cycles are carried out to complete the formation of the package.

Figure 5:
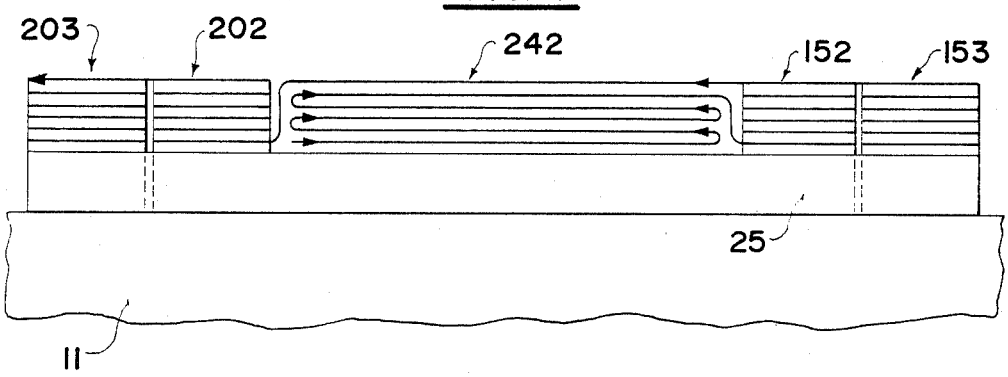
FIG. 5 is a view similar to FIG. 3 showing a further modified package build.

FIG. 5 illustrates a further modified arrangement in which the flanged portions are each formed by two separate spiral windings indicated at 202, 203 and 152, 153. The central traverse portion is indicated at 242. This arrangement is of particular value when very narrow tapes are employed which require a second stabilizing spiral in order to form a sufficiently stable flange at the end of the package. The spirals are spaced from each other by a distance less than the width of the tape to prevent the tape slipping down between the spirals.

Returning now to FIG. 1, the apparatus comprises a main stationary frame 26 which is shown only schematically but supports the drive motors and brackets necessary for the machine. The main frame 26 is of conventional construction and hence is not shown in detail for simplicity of illustration. The main frame 26 carries the guides 121 for the tape 13 forwarded from the supply. The tape 13 can be one of a number of such tapes slit from a film at an apparatus station upstream of the winding apparatus. A plurality of such tapes may be wound on the apparatus but only one winding station is shown in FIG. 1.

A traversing support frame 27 is provided adjacent the main frame 26 and as explained hereinafter can be traversed transversely to the direction of movement of the tape 13 to traverse the winding position of the tape along the cylindrical core 11 to form the cylindrical package. In practice the traversing carriage 27 will support a number of winding positions so that they are traversed simultaneously to wind the tapes 13 forwarded from the supply.

The main frame 26 carries a pair of pivot arms 28 which in turn support a package drive roller 29 carried on a shaft 30 and driven by a timing belt and pulley 31. The arms 28 are freely pivoted on the main frame 26 so that the roller 29 presses downwardly under its own weight onto the package supported by the traversing carriage 27. The guide 121 comprises a shaft 122 supported on the arms 28 and a pair of collars 123 spaced by the width of the tape so that the tape passes over the shaft 122 between the collars 123 to be guided onto the roller 29 around which it is wrapped so as to maintain a constant position axially of the roller 29. The shaft 122 can support a number of further collars (not shown) to guide further tapes issuing from the supply downwardly to further winding positions (not shown).

The winding position on the traversing carriage 27 comprises a shaft 32 mounted on bearings 33 in upstanding side walls 34 of the carriage 12. In practice each additional winding position (not shown) will include a shaft 32 mounted on the walls 34. The cylindrical core 11 on which the package is to be wound is mounted on the shaft 32 and the shaft 32 includes means (not shown) for releasing the package for replacement by an empty package when filled.

The shaft 32 extends beyond the wall 34 at one end thereof and includes a sensor assembly 35 which rotates with the shaft 32 and generates a series of pulses for each rotation of the shaft 32. The carriage 27 is mounted on anti-friction slides 36 which ae conventional in form and it suffices to say that they allow transverse movement of the carriage 27. The carriage is driven in its traverse movement by a lead screw 37 on which a nut 38 is carried and attached to the side wall 34 of the carriage 27. The lead screw 37 is driven by a servo-motor 38 through a suitable gear reducer 39 both of which are mounted upon the main frame 26 again shown schematically. Thus the servo-motor 38 acts to rotate the lead screw 37 by a controlled amount whereby the nut 38 is moved axially of the lead screw to traverse the carriage 27 by a predetermined amount.

Pulses from the proximity sensor assembly 35 are detected by a programmable controller 40 which may be a Potter and Brumfield Series 1000, 1200 or equivalent. Control information issuing from the controller 40 is communicated to the servo-motor 38 via an electronic control circuit assembly 41 so as to control the servo-motor 38 in dependence upon the condition of the package as sensed by the sensor 35.

The complete structure of the package can therefore be programmed into the controller 40 so that the controller is aware at all times of how many rotations of the core 11 have occurred and can position the core axially relative to the winding portion defined by the guide 121 accordingly.

I claim:

1. A method of building a package of tape wound on a core comprising forwarding the tape from a supply thereof, guiding the tape to a winding position on the core, rotating the core to wrap the tape around the core and traversing the winding position across the core to form a package, the improvement wherein at each end of the package the winding position is during the package build repeatedly maintained stationary for a period of time sufficient to wind during each period a separate spiral winding of greater than two full turns whereby to form at each of the package a flanged portion of the package which substantially consists of said spiral windings and in between said flanged portion the winding position is, during the package build, repeatedly traversed axially of the package to wind the tape helically of the core and to reverse in helical traverse direction at a position inwardly of one of said flanged portions to form a helical traversed portion of the package having a plurality of inter-connected helical traverses within the flanged portions, the number of helical traverses being arranged relative to the number of turns in spiral windings such that the diameter of the flanged portions and the helical traversed portion are maintained substantially equal during the package build.

2. The method according to claim 1 wherein the helical traverse portions are formed prior to the spiral windings.

3. The method according to claim 2 wherein each flanged portion is formed by two axially spaced positions each including spearate spiral windings.

4. The method according to claim 2 wherein the flanged portions are formed so as to be self-supporting without the need for flanges on the core for supporting the ends of the package.

5. The method according to claim 1 wherein the flanged portions are formed so as to be self-supporting without the need for flanges on the core for supporting the ends of the package.

6. The method according to claim 1 wherein a space between the inner edge of the flanged portion and the respective reversal is less than the width of the tape.

7. The method according to claim 1 wherein each flanged portion is formed by two axially spaced positions each including separate spiral windings.

8. A package of tape including at each end a respective one of a pair of flanged portions and a helical traverse portion intermediate the flanged portions, the flanged portions each substantially consisting of a series of separate over-laying spiral windings of greater than two full turns and the helical traverse portion being comprised of a series of separate helical traverses, each separate spiral winding of a flanged portion being separated from the next over-laying by one of said separate helical traverses and arranged such that the diameter of the flanged portion at said separate spiral winding is substantially equal to the diameter of said helical traverse portion at said separate helical traverse, each separate helical traverse having at least one direction reversal positioned inwardly of a respective inner edge of one of the flanged portions.

9. A package according to claim 8 wherein each flanged portion is formed by two axially spaced positions each including said separate spiral windings.

10. A package according to claim 8 wherein the core is free from flanges for supporting the ends of the package.

11. A package according to claim 8 wherein there is provided between the inner edge of the flanged portion and a respective reversal a space which is less than the width of the tape.

12. An apparatus for building a package of tape on a core comprising means for forwarding the tape from a supply thereof, guide means for guiding the tape to a winding position on the core, means for supporting the core for rotation relative to the winding position to wrap the tape around the core, traverse means for traversing the winding position relative to the core to form a package and traverse control means arranged such that at each end of the package the winding position is during the package build repeatedly remained stationary for a period of time sufficient to wind during each period a separate spiral winding of greater than two full turns whereby to form at each end of the package a flanged portion of the package which is substantially comprised of said spiral windings, such that in between said flanged portions the winding position is during the package build repeatedly raversed axially of the package including at least one reversal in traverse direction arranged inwardly of said flanged portions to wind the tape helically of the core to form a helical traversed portion of the package and such that the number of traverses is arranged relative to the number of turns in the spiral windings such that the diameter of the flanged portions and of the helical traversed portion are maintained substantially equal.

* * * * *